United States Patent [19]

Hipple

[11] 4,007,344

[45] Feb. 8, 1977

[54] PRESSURE OPERATED ELECTRICAL SWITCH CONSTRUCTION

[75] Inventor: George M. Hipple, Columbus, Ohio

[73] Assignee: Robertshaw Controls Company, Richmond, Va.

[22] Filed: Aug. 12, 1975

[21] Appl. No.: 604,025

[52] U.S. Cl. ..... 200/83 SA; 200/67 R

[51] Int. Cl.[2] ..... H01H 35/34

[58] Field of Search ..... 200/67 R, 83 P, 83 S, 200/83 SA

[56] References Cited

UNITED STATES PATENTS

| | | | |
|---|---|---|---|
| 2,620,413 | 12/1952 | Johnson | 200/83 SA |
| 2,919,321 | 12/1959 | Lung | 200/83 SA |
| 3,345,480 | 10/1967 | Zeller | 200/83 SA |

*Primary Examiner*—Gerald P. Tolin
*Attorney, Agent, or Firm*—Candor, Candor & Tassone

[57] ABSTRACT

A pressure operated electrical switch construction having a housing provided with a pressure responsive actuator and an electrical switch operatively associated with the actuator so that the actuator will operate the switch from one condition thereof to another condition thereof when the sensed pressure reaches a predetermined pressure. A reset device is carried by the housing for resetting the switch from the other condition thereof back to the one condition thereof. A range spring is carried by the housing for acting on the actuator to provide the predetermined pressure. A reset spring, forming part of the reset device, acts on the actuator to reset the switch. The two springs are concentrically disposed with one of the springs being disposed completely inside the other spring to render the switch construction compact even though the switch construction has a fixed reset or a proportional reset. An adjustable cam is carried by the housing and adjusts the range spring when the cam is moved relative to the housing in one direction and operates the reset device when moved in a direction transverse to the one direction thereof.

39 Claims, 17 Drawing Figures

PRESSURE OPERATED ELECTRICAL SWITCH CONSTRUCTION

This invention relates to an improved pressure operated electrical switch construction.

It is well known that pressure operated electrical switch constructions have been provided wherein a condition responsive means moves an actuator of the switch construction to operate an electrical switch thereof with such switch construction having reset means for resetting the switch after ths same has been operated by the actuator, For example, such pressure operated switch constructions are used in automatic clothes washers, dishwashers, sump pumps, etc., wherein the water level controls the pressure operated means of the switch construction.

It is a feature of this invention to provide a relatively thin pressure operated electrical switch construction of the above type.

It is well known that such pressure operated electrical switch constructions each must be sensitive to very low pressures, such as those created by only a few inches of water. Such switch constructions must also be capable of controlling motors of the size usually used in appliances requiring such a switch construction. In order to meet these demands, a diaphragm of sufficient diameter to convert the very low pressures to a force sufficient to operate the switch device of this capacity is required and for switch constructions that have an adjustable trip pressure, a further requirement is a choice of modes of operation which determines the pressure at which the switch resets as pressure is reduced below the trip point.

For example, for the fixed reset mode, the pressure reset point of the switch is fixed regardless of the setting of the pressure trip point. For the fixed differential mode, the pressure trip point and the reset pressure have a fixed difference beween the two values. For the proportional mode, the difference between the pressure trip point and the pressure reset point is proportional to the pressure trip setting.

A further requirement of the switch constructions of the above type is that they also be made non-adjustable whereby the trip and reset pressure values are determined during the manufacture thereof.

Accordingly, it is the feature of this invention to provide all of the above features in a basic switch assembly requiring only minor changes in the assembly of the parts thereof to provide the desired mode of operation thereof.

Another feature of this invention is to provide such a switch assembly in a most compact configuration thereof.

In particular, one embodiment of this invention provides a pressure operated electrical switch construction having a housing means provided with a pressure responsive actuator and an electrical switch that is operatively associated with the actuator so that the actuator will operate the switch from one condition thereof to another condition thereof when the sensed pressure reaches a predetermined pressure. Reset means is carried by the housing means for resetting the switch from the other condition thereof back to the one condition thereof. A range spring is carried by the housing means for acting on the actuator to provide the predetermined pressure. A reset spring is carried by the housing means for acting on the actuator to reset the switch whereby the reset spring comprises part of the reset means. The springs are concentrically disposed with one of the springs being disposed completely inside the other spring to render the switch compact even though the switch construction has a fixed reset or a proportional reset.

The pressure operated switch construction of this invention can have adjustable means for adjusting the range spring and thereby adjusting the pressure trip point of the switch by the actuator thereof, the adjusting means adjusting the range spring when the adjusting means is manually moved relative to the housing means in one direction and operating the reset means when manually moved in a direction transverse to said one direction.

Accordingly, it is an object of this invention to provide an improved pressure operated electrical switch construction having one or more of the novel features set forth above or hereinafter shown or described.

Other objects, uses and advantages of this invention are apparent from a reading of this description which proceeds with reference to the accompanying drawings forming a part thereof and wherein.

Figure 1:
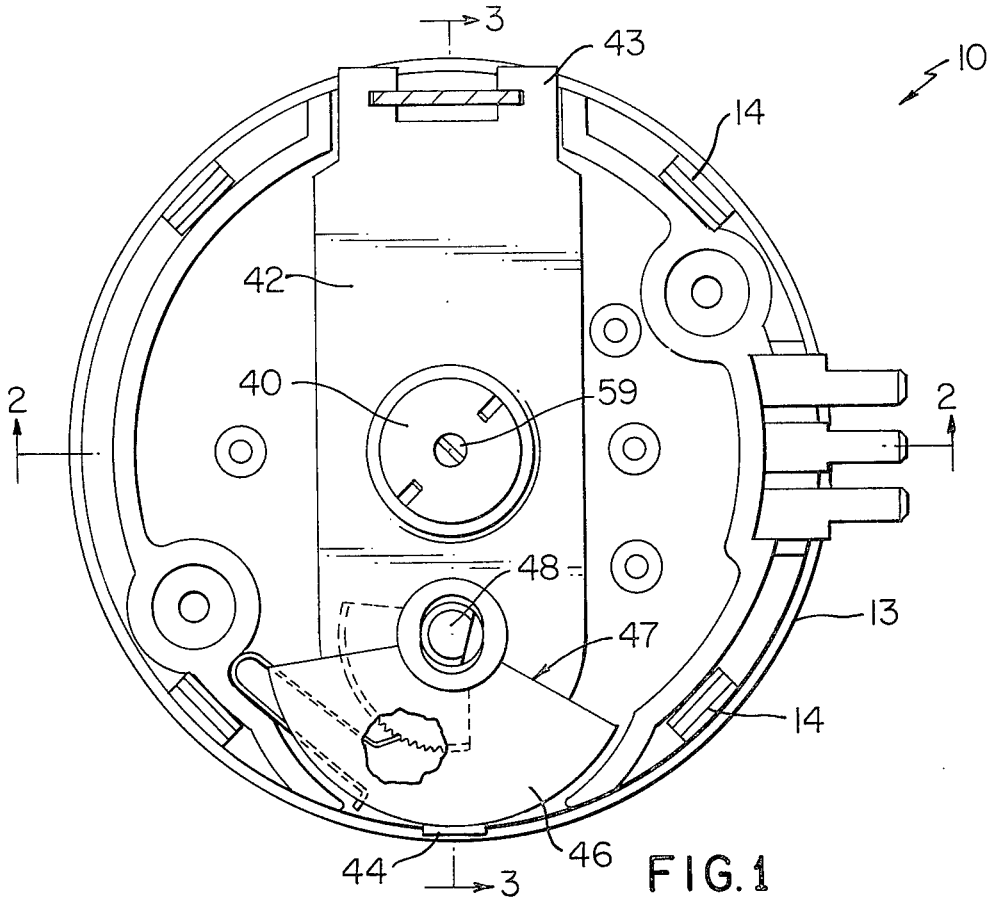
FIG. 1 is a top view of the improved pressure operated electrical switch construction of this invention with the cover thereof removed.

While the various features of this invention are hereinafter described and illustrated as being particularly adapted to provide a pressure operated electrical switch construction for sensing water level conditions, it is to be understood that the switch construction of this invention can be utilized with other condition responsive means as desired.

Therefore, this invention is not to be limited to only the embodiments illustrated in the drawings, because the drawings are merely utilized to illustrate one of the wide variety of uses of this invention.

Referring now to FIGS. 1—4, the improved electrical switch construction of this invention is generally indicated by the reference numeral 10 and comprises a housing means that is generally indicated by the reference numeral 11 and formed of a pair of housing parts 12 and 13 held together by spring clips 14 or other suitable fastening means to trap an outer peripheral portion 15 of a flexible diaphragm 16 therebetween whereby the flexible diaphragm 16 cooperates with the housing part 13 to define a chamber 17 therebetween adapted to be interconnected to a water level source by a nipple means 18' in a conventional manner.

In this manner, an increase in the water level being sensed by the switch construction 10 will increase the air pressure in the chamber 17 and thereby tend to move the diaphragm 16 upwardly in the drawings. Conversely, a lowering of the water level will cause a decrease in the air pressure in the chamber 17 permitting the diaphragm 16 to move downwardly in the drawings.

An electrical switch is carried by the housing means 11 and is generally indicated by the reference numeral 18 and comprises a pair of fixed contacts 19 and 20 disposed in spaced apart relation with a movable contact means 21 disposed therebetween, the movable contact 21 being carried by a snap spring switch blade 22 that is cantilevered mounted to the housing part 12 by a fastening means 23 and rendered snap acting by a rolling C-shaped spring 24 in a conventional manner.

Figure 2:
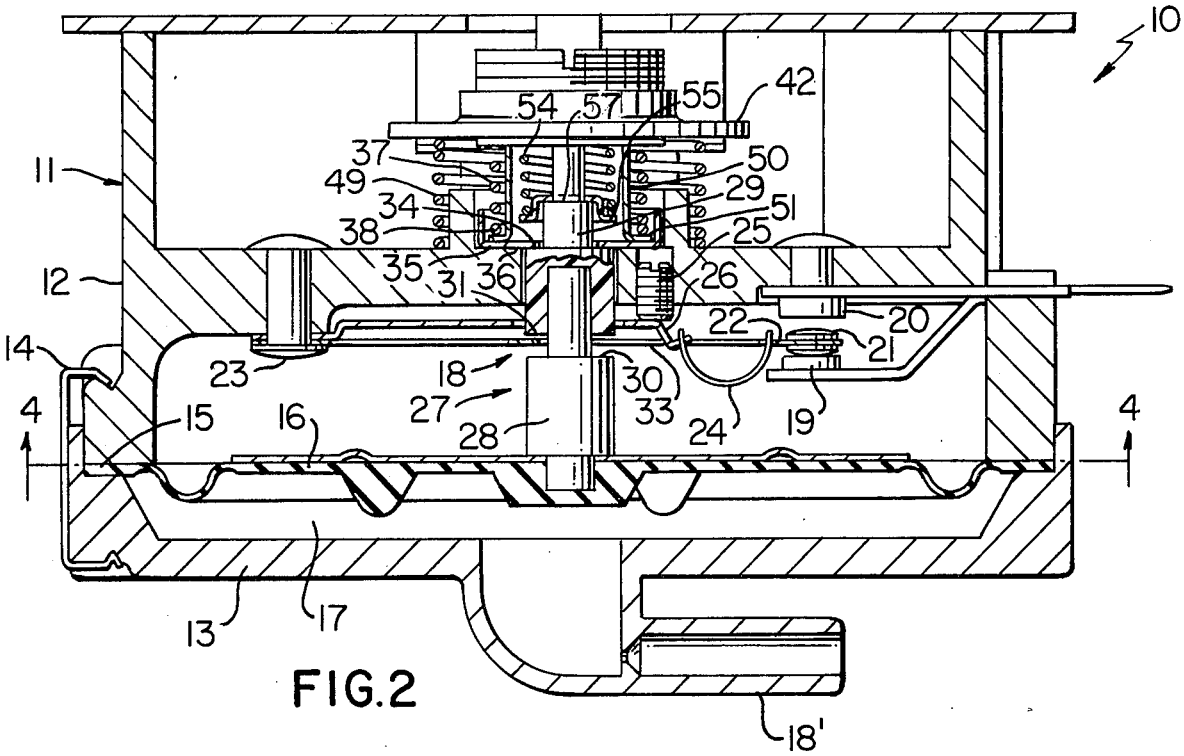
FIG. 2 is a cross-sectional view taken on line 2—2 of FIG. 1.

An adjusting screw 25 is carried by the housing part 12 and is operatively associated with a retainer 26 for the rolling spring 24 to adjust the same so that when the switch blade 22 is on one side of its center position, the spring 24 holds the movable contact 21 in contact with the fixed contact 19 as illustrated in FIG. 2 and when the switch blade 22 is moved over center in a manner hereinafter described, the spring 24 will hold the movable contact 21 against the fixed contact 20 as will be apparent hereinafter.

An actuator for the switch construction 10 is generally indicated by the reference numeral 27 and comprises a pair of plunger means 28 and 29 assembled together to define a pair of spaced apart abutments 30 and 31 for respectively straddling and operating on the switch blade 22 in a manner hereinafter described as an intermediate part 32 of the actuator 27 passes through suitable opening means 33 in the blade 22 as illustrated.

The actuator 27 has another abutment means or shoulder 34 against which an annular spring retainer 35 can engage as illustrated in FIG. 2 so that when the spring retainer 35 is disposed against a stop surface 36 of the housing part 12, the same holds the actuator 27 in the position illustrated in FIG. 2 wherein the shoulders 31 and 30 are respectively spaced from the switch blade 22 when the switch blade 22 is in the condition illustrated in FIG. 2 so that the movable contact 21 is disposed against the fixed contact 19 as illustrated.

A coiled compression range spring 37 has its lower end 38 effectively bearing down on the spring retainer 35 to urge the same against the stop shoulder 36 of the housing 12 while the other end 39 thereof bears against an adjustable spring retainer 40 threaded into a threaded opening 41 of a cam plate 42 pivotally mounted to the housing means 12 at the end 43 thereof while the other end 44 thereof bears against a cam surface 45 of a cam part 46 of a selector means that is generally indicated by the reference numeral 47.

The selector means 47 includes a shaft portion 48 rotatably mounted to the housing means 12 as illustrated and carrying the cam part 46 for operating on the end 44 of the cam plate 42 to determine its pivotal position relative to the housing means 12 and, thus, the force of the range spring 37 acting downwardly on the actuator 27 as will be apparent hereinafter.

Should it be found that the range spring 37 is not of sufficient force to maintain the cam plate 42 in its operative engagement with the cam surface 45 of the cam part 46, a cam plate compression spring 49 can be disposed between the cam plate 42 and the housing 12 to urge the cam plate 42 in a counterclockwise direction in the drawing so that the end 44 is always maintained in contact with the cam surface 45 of the cam part 46 as illustrated.

Figure 4:
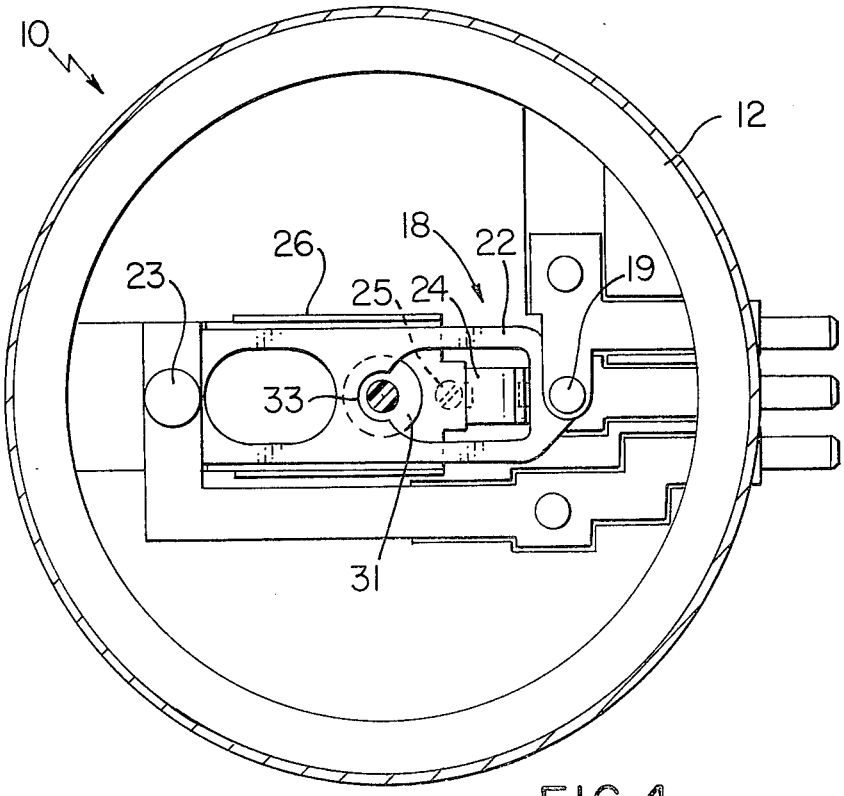
FIG. 4 is a cross-sectional view taken substantially on line 4—4 of FIG. 2.
Figure 3:
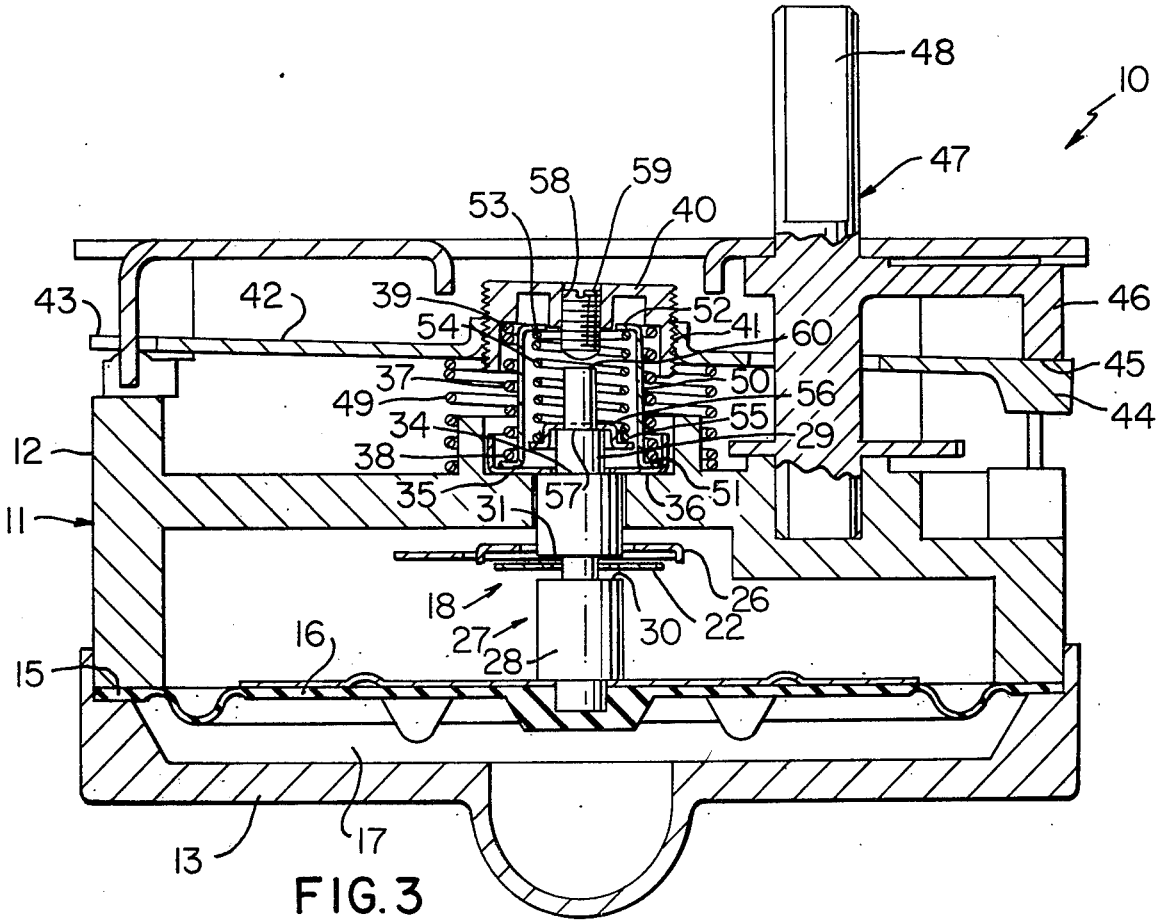
FIG. 3 is a cross-sectional view taken on line 3—3 of FIG. 1.

In the embodiment of the switch construction 10 illustrated in FIGS. 2–4, another spring retainer 50 is disposed inside the range spring 37 and has an outwardly directed annular lower flange 51 disposed between the lower end 38 of the range spring 37 and the spring retainer 35 while having an upper inwardly directed annular flange 52 against which one end 53 of a coiled compression reset spring 54 engages, the lower end 55 of the reset spring 54 bearing against a spring retainer 56 disposed against a shoulder 57 of the actuator 27 as illustrated.

The spring retainer 50 operates with the reset spring 54 to cause the embodiment of the pressure operated switch construction 10 of this invention of FIGS. 1–4 to operate with a fixed reset mode, i.e., even though the trip point of the switch construction 10 is adjustable by the selector means 47 in a manner hereinafter described, the pressure reset point of the switch construction 10 is fixed as will be apparent hereinafter.

Figure 5:
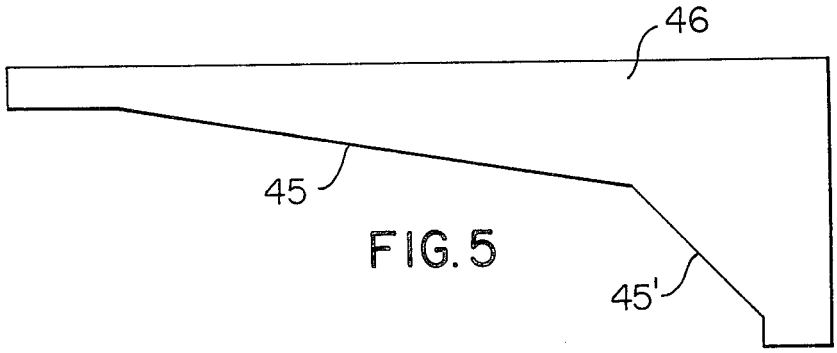
FIG. 5 is a plane view schematically illustrating the cam surface of the selector means of the switch construction of FIG. 1.

If desired, the cam surface 45 on the cam part 46 of the selector means 47 can have a sloping configuration as illustrated in FIG. 5 with one end of the cam surface 45 being a relatively sharp depending cam surface 45' that is provided for causing a reset action on the cam plate 42 as will be apparent hereinafter.

The threaded retainer 40 of the cam plate 42 has a threaded bore 58 threadedly receiving a threaded adjusting member 59 which is adapted to act on the end 60 of the actuator means 27 for a manual resetting action thereof as will be apparent hereinafter.

From the above description of the embodiment of the electrical switch construction 10 of this invention as illustrated in FIGS. 1–4, it can be seen that the switch construction 10 is relatively compact because the reset spring 54 is concentrically disposed completely within the range spring 37 to permit the switch construction 10 to operate in a manner now to be described.

Assuming that the operator has turned the selector shaft 48 to a desired position so that the cam surface 45 operating on the end 44 of the pivot plate 42 will cause the switch construction 10 to have its movable contact 21 moved away from the fixed contact 19 and engaged against the fixed contact 20 when the water level being sensed by the device 10 reaches a certain level, the switch construction 10 will remain in the condition illustrated in FIG. 2 as long as the water level is below that preselected level as the setting of the range spring 37 by the cam plate 42 has been predetermined by the setting of the selector shaft 48.

However, when the water level reaches the selected level or increases slightly beyond the same, the fluid pressure in the chamber 17 has increased in such a manner that the same drives the diaphragm 16 upwardly in opposition to the force of the range spring 37 and raises the retainer 35 off of the shoulder 36 of the housing 12 until the shoulder 30 of the actuator 27 engages against the switch blade 22 and causes the switch blade 22 to snap over center and move the movable contact 21 out of contact with the fixed contact 19 and into contact with the fixed contact 20 whereby the movable contact 21 will remain in contact with the fixed contact 20 until the pressure in the chamber 17 falls to a certain fixed amount.

In particular, as the water level being sensed by the device 10 begins to fall, the force of the range spring 37 moves the actuator 27 and diaphragm 16 downwardly until the retainer 35 seats against the surface of the housing 12 at which position the retainer 35 has moved the actuator 27 to the position illustrated in FIG. 2. However, at this position of the actuator 27, the surface 31 of the actuator 27 has not engaged the switch blade 22 so that the switch blade 22 is still maintained in its up condition with the movable contact 21 against the fixed contact 20. A further decrease in pressure in the chamber 17 causes the reset spring 54 to operate against the shoulder 57 of the actuator 27 and move the actuator 27 downwardly from the position illustrated in FIG. 2 until the shoulder 31 of the actuator 27 engages against the blade 22 and moves the same downwardly so that the blade 22 will snap over center and move the movable contact 21 away from the fixed contact 20 and again into contact with the fixed contact 19.

Therefore, it can be seen that the spring retainer 50 insures that the reset spring 54 will only reset the control device 10 at the same predetermined pressure in the chamber 17 regardless of the setting of the range spring 49 through the cam plate 42 so that the switch construction 10 of this invention as illustrated in FIGS. 1–5 is of the "fixed reset" type wherein the pressure reset point of the switch is fixed regardless of the setting of the pressure trip point.

However, should it be desired to convert the pressure operated electrical switch construction 10 of this invention to operate with a proportional mode wherein the difference between the pressure trip point and the pressure reset point is proportional to the setting of the pressure trip setting, the retainer 50 can be eliminated and, if desired, the reset spring 54 can be made to be independently adjustable from the range spring 37 during manufacture so that a variety of proportions between the trip pressures and the reset pressures can be assembled and adjusted into the switch assembly.

Figure 6:
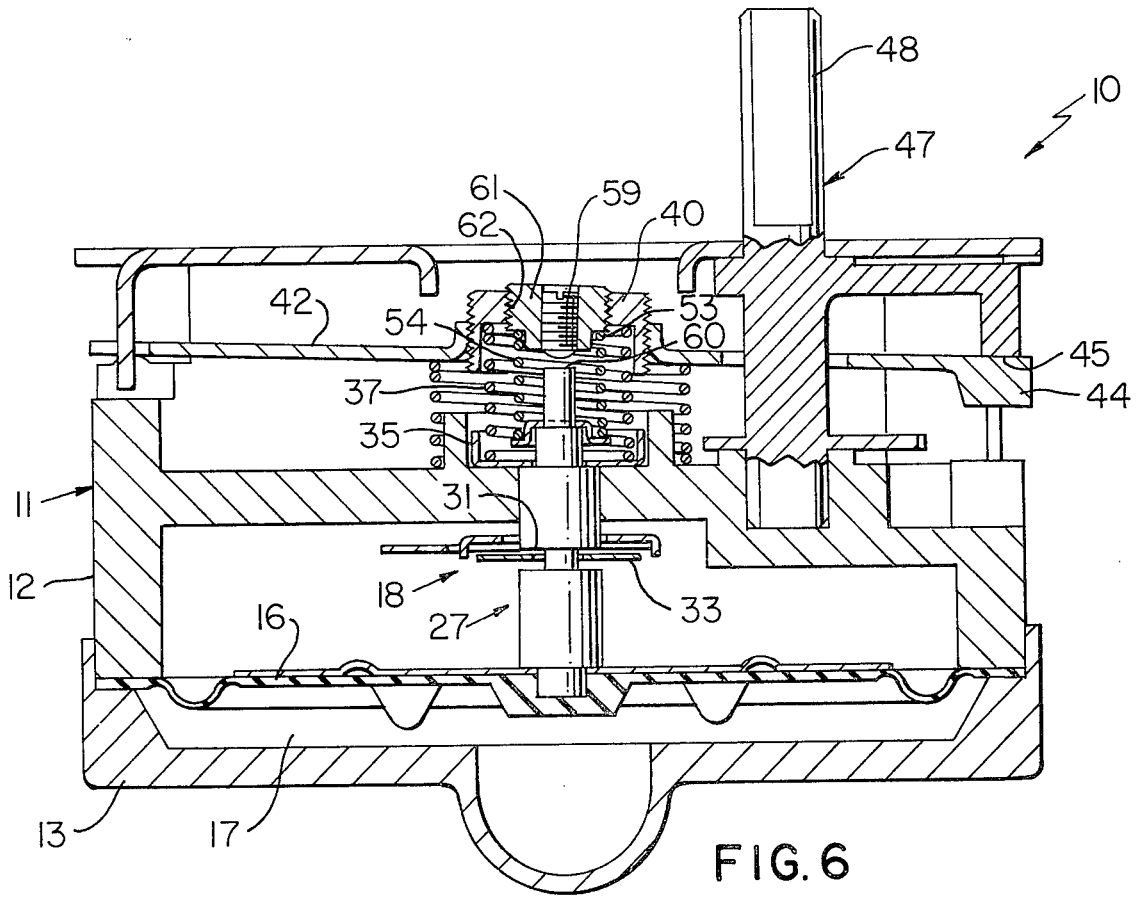
FIG. 6 is a view similar to FIG. 2 and illustrates the electrical switch construction of this invention when utilized in the proportional mode thereof.

For example, reference is now made to FIG. 6 wherein the switch construction 10 of FIGS. 1–5 has been converted to a switch construction of the proportional mode by eliminating the retainer 50 and having the upper end 53 of the range spring 54 bear against a threaded member 61 disposed in a threaded bore 62 formed in the threaded spring retainer 40 and itself carrying the reset adjusting screw 59.

In this manner, when the actuator 27 of the switch construction 10 of FIG. 6 has been moved upwardly to cause the electrical switch 18 to have the movable contact 21 disposed against the upper contact 20, a subsequent decrease of the pressure in the chamber 17 causes the range spring 37 to move the spring retainer 35 and thus the actuator 27 downwardly to the position illustrated in FIG. 6 whereby further movement of the actuator 27 downwardly is accomplished by the reset spring 54 except that the force of the reset spring 54 has been adjusted in manner same manner as the range spring 37 by the cam plate 42 as the cam plate 42, in effect, acts on both springs 37 and 54 during the adjustment of the selector means 47 in the manner previously described.

Therefore, it can be seen that it is a relatively simple matter to convert the switch construction 10 of this invention to operate either as a fixed reset type or as a proportional reset type by merely utilizing the retainer 50 or not utilizing the retainer 50.

While the switch construction 10 of this invention previously described for the embodiments of FIGS. 1–6 is adapted to be automatically reset as previously described, the same can be manually reset even though the pressure in the chamber 17 hasn't fallen below or to the level which will permit the reset spring 54 to reset the same. In particular, the operator can turn the selector shaft 48 so that the steep cam surface 45' will operate on the end 44 of the pivot plate 42 to move the same downwardly whereby the adjusting screw 59 will engage against the end 60 of the actuator 27 to move the same downwardly and cause the shoulder 31 of the actuator 27 to engage against the switch blade 22 to move the same downwardly and thereby move the movable contact 21 out of contact with the fixed contact 20 and into contact with the lower contact 19.

Of course, by completely eliminating the reset spring 54 from the control device 10 of this invention, the switch construction 10 can be made to be only manually resettable by turning the selector shaft 48 to the reset position thereof.

Figure 7:
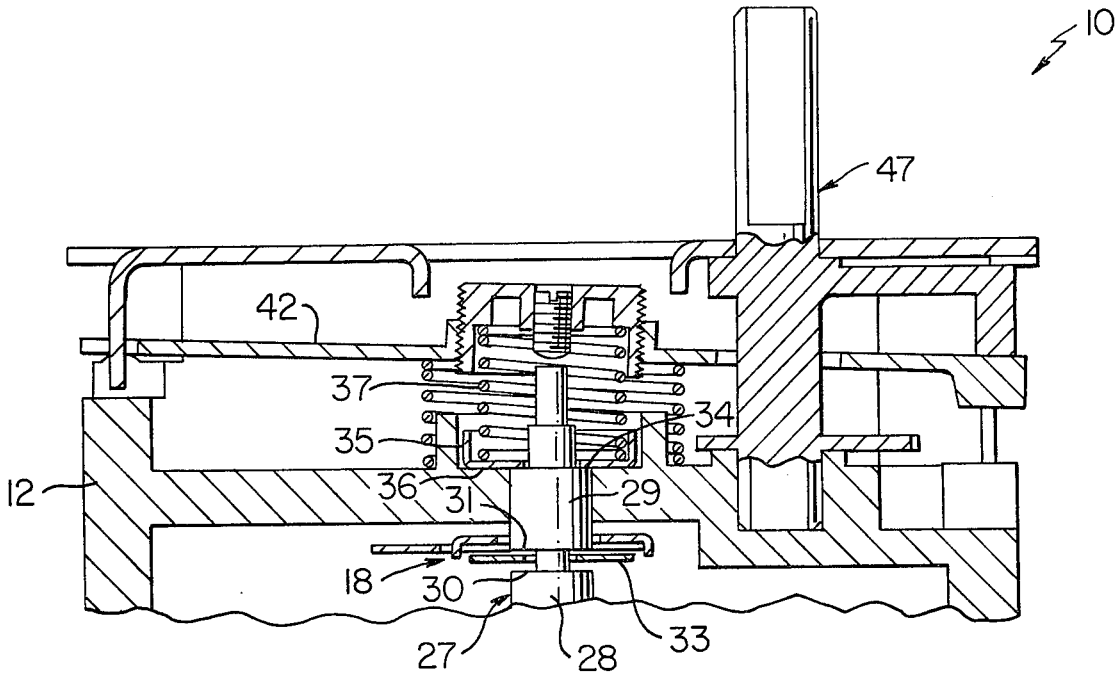
FIG. 7 is a view similar to FIG. 2 and illustrates the electrical switch construction of this invention when utilized in the fixed differential mode thereof.

Further, should it be desired to have the switch construction 10 operate with a fixed differential mode wherein the pressure trip point and the reset pressure have a fixed difference between the two values regardless of the setting of the trip point, the reset spring 54 and spring retainers 50 and 56 are eliminated as illustrated in FIG. 7 and the upper actuator portion 29 of the actuator means 27 is made longer between the shoulders 31 and 34 thereof, so that when the range spring 37 is moving the actuator 27 downwardly by a falling pressure in the chamber 17 after the switch 18 has been operated as previously described, the shoulder 31 will engage the switch blade 22 before the spring retainer 35 bottoms out on the surface 36 of the housing 12 to push the spring blade 22 over center and thereby move the movable contact 21 away from the fixed contact 20 and engagement with fixed contact 19.

This downward movement of the actuator 27 causes the switch 18 to reset without the need of an additional reset spring. The vertical displacement of the actuator 27 to alternately trip and reset the switch 18 is constant and determined by the gap between the two push rod sections 28 and 29 of the actuator 27 at the surfaces 30 and 31 thereof. Regardless of the compression or trip pressure setting of the range spring 37, the range spring 37 will undergo a fixed displacement as the switch 18 alternately trips and releases as the result of varient pressure on the diaphragm 16. The rate or force per inch of displacement of the range spring 37 is a constant, thus this fixed displacement produces a fixed force difference between the trip and reset positions. The difference between the trip pressure and the reset pressure is therefore fixed so that even though the range spring 37 is adjusted by the cam plate 42 as previously described, there is still a fixed differential between the trip and reset pressures in the chamber 17.

If it is desired to make the switch construction 10 of this invention non-adjustable in the trip pressure thereof with a fixed reset or fixed differential in the resetting thereof, the cam plate 42 can be eliminated and the adjustable spring retainer 40 can be carried by the top frame structure of the housing means 11.

Figure 9:
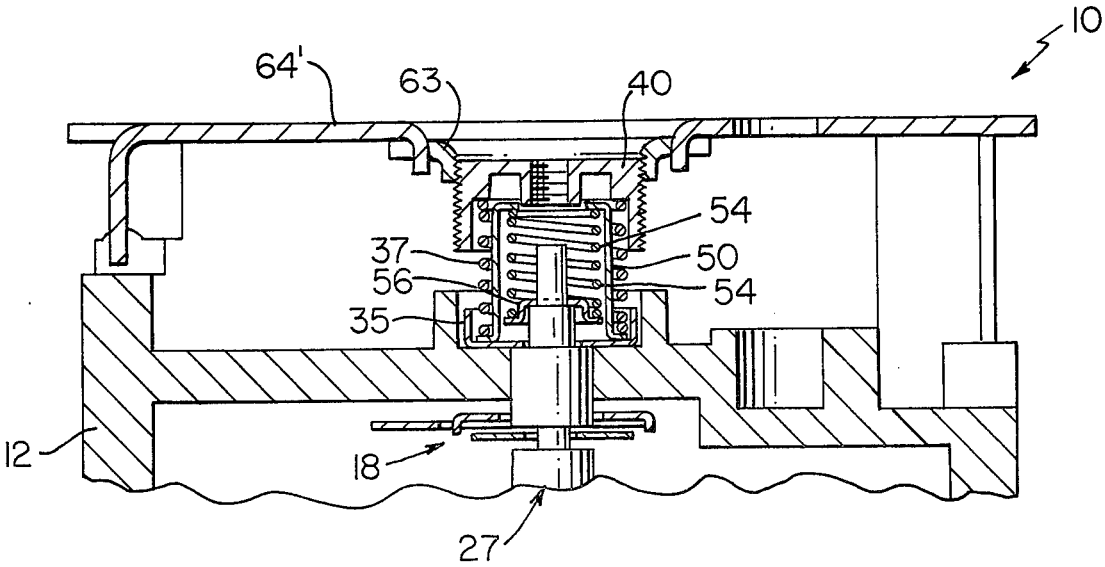
FIG. 9 is a view similar to FIG. 2 and illustrates the electrical switch construction of this invention when utilized in the non-adjustable condition thereof.

In particular, reference is now made to FIG. 9 wherein the spring retainer 40 is threaded into a washer-like member 63 fastened to the frame structure 64' so that the setting of the range spring 37 is a factory operation and once the device 10 is in the field, there is no adjusting of the range spring 37 and the trip pressure is thereby factory calibrated and set. Of course, the reset pressure can be made to be fixed by utilizing the spring retainer 50 as illustrated in FIG. 9 or by eliminating the spring retainer 50 and making the same proportional by having the reset spring 54 also engage the spring retainer 40 or be eliminated to have a fixed differential mode as in the embodiment of FIG. 7.

Therefore, it can be seen that the switch construction 10 of this invention can readily be changed to operate in the desired manner in a relatively simple manner by merely changing a relatively few parts thereof as the basic parts of the switch construction 10 remain in all of the embodiments thereof.

Figure 8:
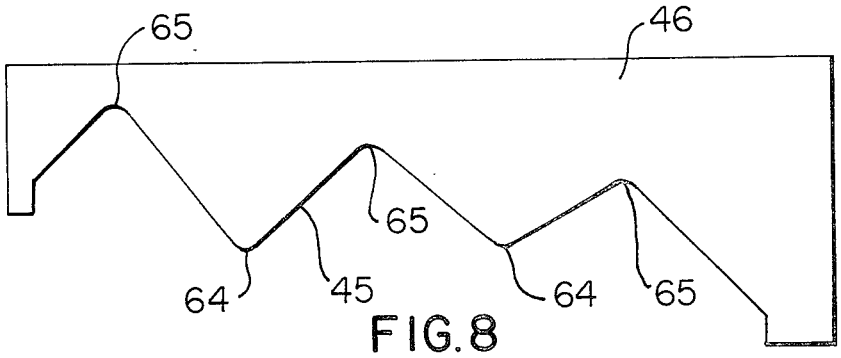
FIG. 8 is a plane view schematically illustrating the cam structure of the switch construction of this invention when utilized in the fixed differential mode thereof of FIG. 7.

Further, should it be desired to have the selector means 47 provide for certain incremental settings of the range spring 37, with automatic reset operation inbetween such incremental settings thereof, the cam surface 45 can be constructed in the manner illustrated in FIG. 8 wherein the cam 46 has the cam surface 45 provided with a plurality of low parts 64 disposed between different high parts 65 thereof as illustrated so that as the cam 46 is being rotated, the cam surface 45 operates on the cam plate 42 to cause the same to reset automatically as the points 64 are reached and to be set to predetermined positions when the high points 65 are reached.

If desired, the pressure operated electrical switch construction 10 of this invention can be provided with a unique resetting means thereof which permits the selector shaft 48 to be inwardly pushed a certain distance to cause manual resetting of the switch construction.

For example, reference is now made to FIGS. 10–16 wherein another embodiment of the pressure operated electrical switch construction of this invention is generally indicated by the reference numeral 10A and parts thereof similar to the switch construction 10 previously described are indicated by like reference numerals followed by the reference letter A.

Figure 10:
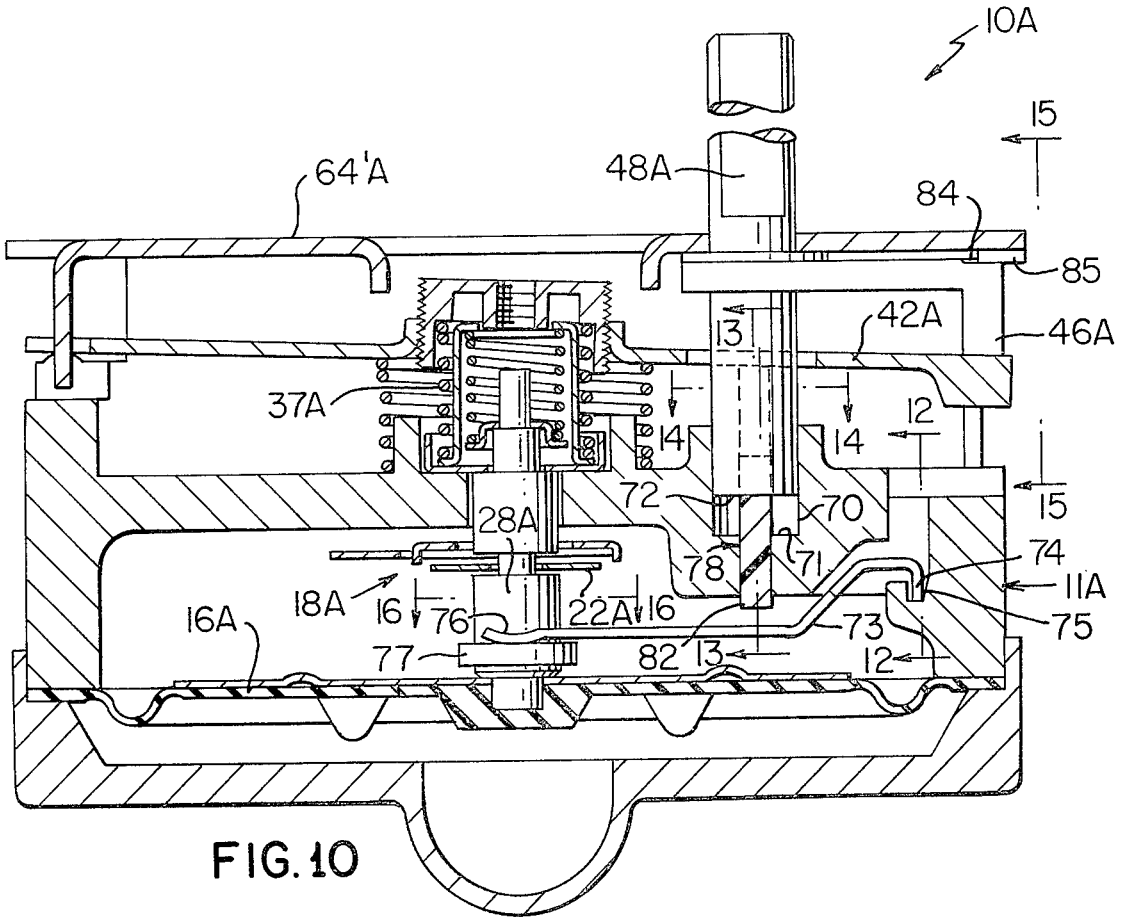
FIG. 10 is a view similar to FIG. 3 and illustrates another embodiment of the pressure operated switch construction of this invention.
Figure 11:
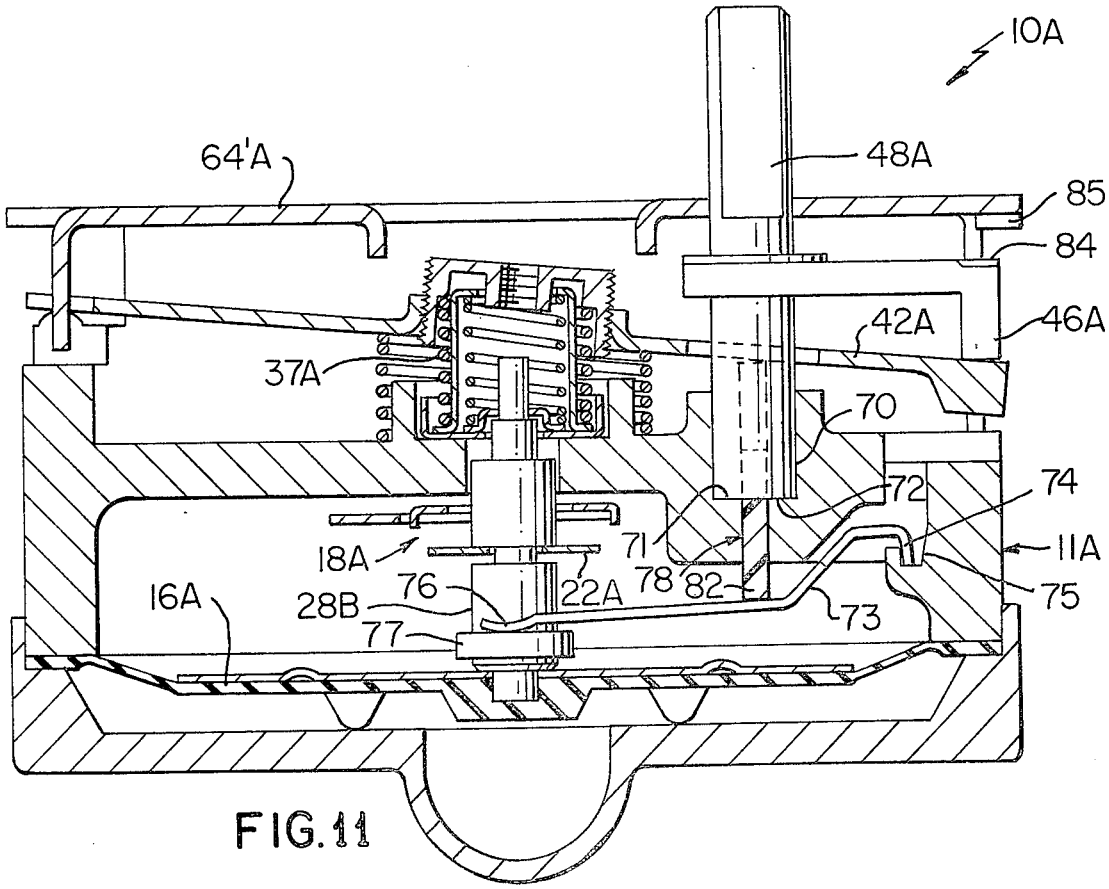
FIG. 11 is a view similar to FIG. 10 and illustrates the switch construction in a resetting condition thereof.
Figure 12:
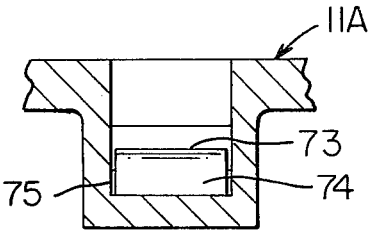
FIG. 12 is a fragmentary cross-sectional view taken on line 12—12 of FIG. 10.

As illustrated in FIGS. 10 and 11, it can readily be seen that the switch construction 10A is substantially identical to the switch construction 10 previously described with the same being arranged for a fixed differential mode of operation as provided in FIGS. 2 and 3. However, the selector shaft 48A of the switch construction 10A is adapted to be axially moved in a direction transverse to the rotational direction of movement thereof in a bore 70 formed in the housing means 11A whereby the bottom 71 of the bore 70 limits inward movement of the shaft 48A by having the end 72 of the shaft 48A bottom out thereagainst.

A lever 73 has one end 74 pivotally mounted in a recess 75 of the housing means 11A and another end 76 thereof bearing against a shoulder means 77 carried on a modified plunger part 28A of the actuator 18A as illustrated.

Figure 13:
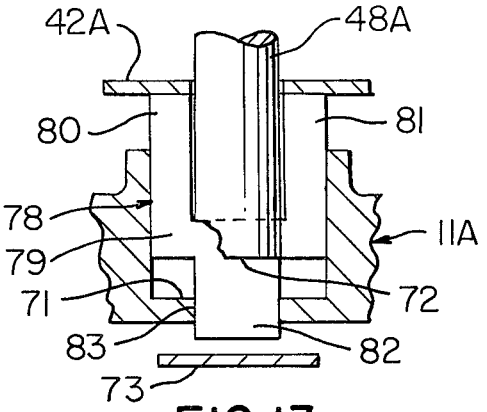
FIG. 13 is a fragmentary cross-sectional view taken on line 13—13 of FIG. 10.
Figure 14:
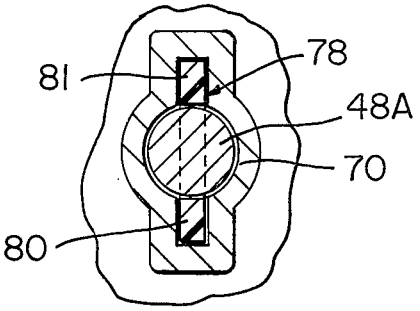
FIG. 14 is a fragmentary cross-sectional view taken on line 14—14 of FIG. 10.

A yoke member or plunger 78 of electrical insulating material has a U-shaped part 79 straddling the end 72 of the selector shaft 48A so that the upper parts 80 and 81 thereof are adapted to be engaged by the plate 42A as illustrated in FIG. 13 while a lower tongue portion 82 thereof is adapted to pass through a slot 83 in the housing means 11A to be engageable with the lever 73 intermediate its ends 74 and 76 in the manner illustrated in FIG. 11 for a manual resetting operation.

In particular, the shaft 48A of the pressure operated electrical switch construction 10A is adapted to be rotated in a manner similar to the selector shaft 48 previously described to adjust the force of the range spring 37A for the purposes previously described.

However, should it be desired to manually reset the switch construction 10A of this invention, the operator merely pushes inwardly on the selector shaft 48A from the position illustrated in FIG. 10 to the position illustrated in FIG. 11 whereby the cam part 46A pushes downwardly on the plate 42A to cause downward pivoting movement thereof and the downward pivoting movement of the plate 42A causes the plunger 78 to move downwardly. Thus, the actuator means 18A resets the electrical switch blade 22A as previously described. Of course, subsequently releasing of the shaft 48A causes the shaft 48A to return to the non-resetting position illustrated in FIG. 10 through the spring action of the springs acting on the plate 42A.

Figure 15:
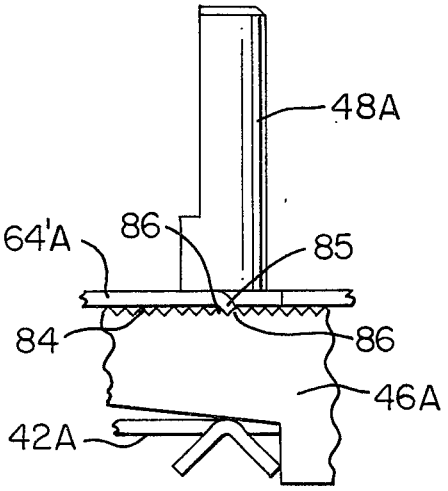
FIG. 15 is a fragmentary cross-sectional view taken on line 15—15 of FIG. 10.

If desired, the cam 46A of the selector shaft 48A can be provided with a serrated upper surface 84 as best illustrated in FIG. 15 while the upper frame plate 64'A has a downwardly directed tongue 85 carved therefrom to be respectively received between adjacent teeth 86 of the serrated edge 84 as illustrated in FIG. 15 to lock the cam 46A from accidental rotation relative to the housing means 11A.

In this manner, the operator must push inwardly on the selector shaft 48A at least a distance sufficient to clear the teeth 86 of the cam 46A from the tongue 85 of the housing means 11A before the selector shaft 48A can be rotated to select the operating force of the range spring 37A in the manner previously described, such inward pushing on the selector shaft 48A to clear the teeth 86 from the tongue 85 only requiring a distance that will not cause a resetting of the switch construction 10A through the action of the lever 73 thereof.

In fact, the lever 73 can be eliminated and the bore 70 of the switch construction 10A could only be of sufficient length to permit the shaft 48A to have the teeth 86 of the cam 46A clear the tongue 85 of the housing means 11A to release the shaft 48A from its locked position for range spring setting purposes without having the manual reset feature of the lever 73 previously described.

Also, it is to be understood that the shaft 48A could directly engage the lever 73 to reset the same without utilizing the insulating yoke or plunger member 78 previously described.

Figure 17:
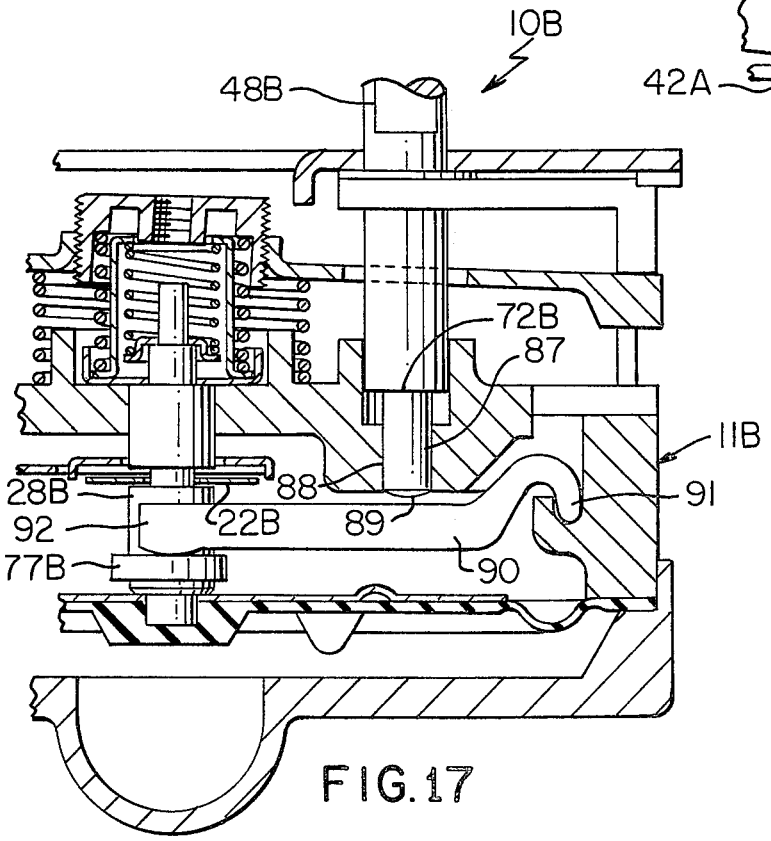
FIG. 17 is a fragmentary view similar to FIG. 10 and illustrates another embodiment of the pressure operated switch construction of this invention.
Figure 16:
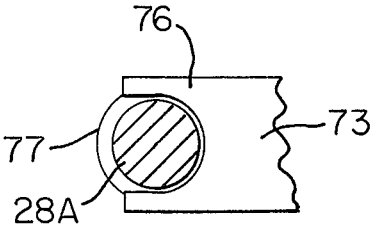
FIG. 16 is a fragmentary cross-sectional view taken on line 16—16 of FIG. 10.

For example, reference is now made to FIG. 17 wherein another embodiment of the pressure operated electrical switch construction of this invention is generally indicated by the reference numeral 10B and parts thereof similar to the switch constructions 10 and 10A previously described are indicated by like reference numerals followed by the reference letter B.

As illustrated in FIG. 17, the selector shaft 48B has a cylindrical extension 87 extending from the end 72B thereof and projecting through an opening 88 in the housing means 11B to have its end 89 engage against a resetting lever 90 formed of electrical insulating material and having one end 91 pivotally mounted to the housing means 11A while the other end 92 thereof engages against the shoulder 77B of the lower part 28B of the actuator 18B as illustrated.

In this manner, the downward movement of the selector shaft 48B by the operator causes the end 89 of the plunger part 87 thereof to engage against the lever 90 and cause counter clockwise pivoting action of the lever 90 so that the actuator 18B will reset the switch blade 22B in the manner previously described for a resetting action of the switch construction 10B.

It is to be understood that the selector shaft 48A of FIG. 10 or the selector shaft 48B of FIG. 17 together with their respective associated resetting levers 73 and 90 can be utilized with the switch construction 10 previously described to provide a manual resetting action thereof whereby the selector means is adapted to be rotated relative to the housing means to set the force of the range spring and also is adapted to be inwardly pushed in a direction transverse to its rotational direction to cause a manual resetting action of the switch construction regardless of what rotational position the selector shaft is set in, the selector shaft additionally having means for locking the same in the selected rotational position thereof, if desired.

Therefore, it can be seen that this invention provides an improved pressure operated electrical switch construction that can provide many different types of modes of operation thereof by merely changing a relatively few non-basic parts thereof so that the switch construction can be adapted to the desired mode of operation for the particular appliance manufacturer.

While the form of the invention now preferred has been illustrated and described as required by the Patent Statute, it is to be understood that other forms can be utilized and still come within the scope of the appended claims.

What is claimed is:

1. In a pressure operated electrical switch construction comprising a housing means, a pressure responsive actuator carried by said housing means, an electrical switch carried by said housing means and being operatively associated with said actuator so that said actuator will operate said switch from one condition thereof to another condition thereof when the sensed pressure reaches a predetermined pressure, and reset means carried by said housing means for resetting said switch from said other condition thereof back to said one condition thereof, the improvement comprising a range spring carried by said housing means for acting on said actuator to provide said predetermined pressure, and a reset spring carried by said housing means for acting on said actuator to reset said switch whereby said reset spring comprises part of said reset means, said springs being concentrically disposed with one of said springs being disposed completely inside the other of said springs to render said switch construction compact even though said switch construction has a fixed reset or a proportional reset, said actuator being concentrically disposed with said springs.

2. In a switch construction as set forth in claim 1, said actuator being disposed inside said reset spring and said reset spring being disposed inside said range spring.

3. In a switch construction as set forth in claim 1, adjustable means carried by said housing means for adjusting said range spring and thereby adjusting the pressure trip point of said switch by said actuator.

4. In a switch construction as set forth in claim 3, means operatively associated with said reset spring to cause said switch to be reset at a fixed pressure reset point regardless of the setting of said pressure trip point of said switch.

5. In a switch construction as set forth in claim 3, said adjustable means also adjusting said reset spring to cause said switch to be reset at a pressure reset point that is proportional to the setting of said pressure trip point.

6. In a switch construction as set forth in claim 5, said adjustable means acting on adjacent ends of said springs to adjust the same.

7. In a switch construction as set forth in claim 1, said housing threadedly carrying a washer-like member that bears against one end of said range spring to set the force of said range spring and, thus, the pressure trip point of said switch by said actuator.

8. In a switch construction as set forth in claim 1, said reset spring being disposed inside said range spring.

9. In a switch construction as set forth in claim 1, said actuator having a pair of spaced abutments for respectively engaging said switch, one of said abutments being adapted to engage said switch to move said switch from said one condition thereof to said other condition thereof and the other of said abutments being adapted to engage said switch to move said switch from said other condition thereof to said one condition thereof.

10. In a switch construction as set forth in claim 9, said actuator having a third abutment, and a spring retainer engaged by said range spring and being adapted to engage said third abutment.

11. In a pressure operated electrical switch construction comprising a housing means, a pressure responsive actuator carried by said housing means, an electrical switch carried by said housing means and being operatively associated with said actuator so that said actuator will operate said switch from one condition thereof to another condition thereof when the sensed pressure reaches a predetermined pressure, and reset means carried by said housing means for resetting said switch from said other condition thereof back to said one condition thereof, the improvement comprising a range spring carried by said housing means for acting on said actuator to provide said predetermined pressure, a reset spring carried by said housing means for acting on said actuator to reset said switch whereby said reset spring comprises part of said reset means, said springs being concentrically disposed with one of said springs being disposed completely inside the other of said springs to render said switch construction compact even though said switch construction has a fixed reset or a proportional reset, adjustable means carried by said housing means for adjusting said range spring and thereby adjusting the pressure trip point of said switch by said actuator, and means operatively associated with said reset spring to cause said switch to be reset at a fixed pressure reset point regardless of the setting of said pressure trip point of said switch, said means operatively associated with said reset spring comprising a spring retainer having one end engaged by one end of said range spring and the other end engaged by one end of said reset spring.

12. In a switch construction as set forth in claim 11, said one end of said spring retainer being engaged with said housing means by said range spring when said pressure falls below said trip point pressure and before said pressure reaches said pressure reset point.

13. In a pressure operated electrical switch construction comprising a housing means, a pressure responsive actuator carried by said housing means, an electrical switch carried by said housing means and being operatively associated with said actuator so that said actuator will operate said switch from one condition thereof to another condition thereof when the sensed pressure reaches a predetermined pressure, and reset means carried by said housing means for resetting said switch from said other condition thereof back to said one condition thereof, the improvement comprising a range spring carried by said housing means for acting on said actuator to provide said predetermined pressure, a reset spring carried by said housing means for acting on said actuator to reset said switch whereby said reset spring comprises part of said reset means, said springs being concentrically disposed with one of said springs being disposed completely inside the other of said springs to render said switch construction compact even though said switch construction has a fixed reset or a proportional reset, and adjustable means carried by said housing means for adjusting said range spring and thereby adjusting the pressure trip point of said switch by said actuator, said adjustable means comprising a pivotally mounted plate acting against one end of said range spring, and an adjustable cam acting against said plate to set the pivot position of said plate and, thus, the pressure trip point of said switch.

14. In a switch construction as set forth in claim 13, said cam being rotatable about an axis that is disposed parallel and spaced from the line of movement of said actuator.

15. In a switch construction as set forth in claim 13, a third spring acting between said housing means and said plate to urge said plate against said cam.

16. In a switch construction as set forth in claim 15, said third spring being concentric with said range spring and said reset spring.

17. In a switch construction as set forth in claim 13, said cam having a reset portion thereof that acts on said plate to move said plate to reset said switch independently of said reset spring.

18. In a switch construction as set forth in claim 17, said reset portion of said cam being at one end of said cam.

19. In a switch construction as set forth in claim 17, said reset portion of said cam being intermediate two operating portions of said cam.

20. In a pressure operated electrical switch construction comprising a housing means, a pressure responsive actuator carried by said housing means, an electrical switch carried by said housing means and being operatively associated with said actuator so that said actuator will operate said switch from one condition thereof to another condition thereof when the sensed pressure reaches a predetermined pressure, and reset means carried by said housing means for resetting said switch from said other condition thereof back to said one condition thereof, the improvement comprising a range spring carried by said housing means for acting on said actuator to provide said predetermined pressure, a reset spring carried by said housing means for acting on said actuator to reset said switch whereby said reset spring comprises part of said reset means, said springs being concentrically disposed with one of said springs being disposed completely inside the other of said springs to render said switch construction compact even though said switch construction has a fixed reset or a proportional reset, and adjustable means carried by said housing means for adjusting said range spring and thereby adjusting the pressure trip point of said switch by said actuator, said adjusting means adjusting said range spring when said adjusting means is manually moved relative to said housing means in one direction and operating said reset means when manually moved in a direction transverse to said one direction.

21. In a switch construction as set forth in claim 20, said adjusting means being rotatably mounted to said housing means and thereby being rotated when moved in said one direction thereof.

22. In a switch construction as set forth in claim 21, said adjusting means being axially movable relative to said housing means to operate said reset means.

23. In a switch construction as set forth in claim 22, said actuator also being axially movable relative to said housing means in the same direction as the resetting movement of said adjusting means.

24. In a switch construction as set forth in claim 23, said adjusting means having detent means for locking said adjusting means in its selected rotational position thereof.

25. In a switch construction as set forth in claim 24, said adjusting means being movable in the resetting direction thereof to clear said detent means so that said adjusting means can thereafter be rotated to adjust said range spring.

26. In a switch construction as set forth in claim 20, said adjustable means comprising a pivotally mounted plate acting against one end of said range spring and an adjustable cam acting against said plate to set the pivot position of said plate and, thus, the pressure trip point of said switch, said adjustable cam being rotatably mounted to said housing means and thereby rotated when moved in said one direction thereof and being axially movable relative to said housing means to operate said reset means.

27. In a switch construction as set forth in claim 26, said housing means having a pivotally mounted lever operatively associated with said actuator and said cam and comprising said reset means, said cam when axially moved pivoting said lever to reset said actuator.

28. In a switch construction as set forth in claim 27, said cam being directly engageable with said lever to cause pivoting movement thereof.

29. In a switch construction as set forth in claim 27, a movable plunger carried by said housing means and being disposed between and engageable with said plate and said lever to cause pivoting movement of said lever as said plate is pivoted by resetting movement of said cam.

30. In a switch construction comprising a housing means, a pressure responsive actuator carried by said housing means, an electrical switch carried by said housing means and being operatively associated with said actuator so that said actuator will operate said switch from one condition thereof to another condition thereof when the sensed pressure reaches a predetermined pressure, reset means carried by said housing means for resetting said switch from said other condition thereof back to said one condition thereof, a range spring carried by said housing means for acting on said actuator to provide said predetermined pressure, and adjustable means carried by said housing means for adjusting said range spring and thereby adjusting the pressure trip point of said switch by said actuator, the improvement wherein said adjusting means adjusts said range spring when said adjusting means is manually moved relative to said housing means in one direction and operates said reset means when manually moved in a direction transverse to said one direction.

31. In a switch construction as set forth in claim 30, said adjusting means being rotatably mounted to said housing means and thereby being rotated when moved in said one direction thereof.

32. In a switch construction as set forth in claim 32, said adjusting means being axially movable relative to said housing means to operate said reset means.

33. In a switch construction as set forth in claim 32, said actuator being axially movable relative to said housing means in the same direction as the resetting movement of said adjusting means.

34. In a switch construction as set forth in claim 33, said adjusting means having detent means for locking said adjusting means in its selected rotational position thereof.

35. In a switch construction as set forth in claim 34, said adjusting means being movable in the resetting direction thereof to clear said detent means so that said adjusting means can thereafter be rotated to adjust said range spring.

36. In a switch construction as set forth in claim 30, said adjustable means comprising a pivotally mounted plate acting against one end of said range spring and an adjustable cam acting against said plate to set the pivot position of said plate and, thus, the pressure trip point of said switch, said adjustable cam being rotatably mounted to said housing means and thereby rotated when moved in said one direction thereof and being axially movable relative to said housing means to operate said reset means.

37. In a switch construction as set forth in claim 36, said housing means having a pivotally mounted lever operatively associated with said actuator and said cam and comprising said reset means, said cam when axially moved pivoting said lever to reset said actuator.

38. In a switch construction as set forth in claim 37, said cam being directly engageable with said lever to cause pivoting movement thereof.

39. In a switch construction as set forth in claim 37, a movable plunger carried by said housing means and being disposed between and engageable with said plate and said lever to cause pivoting movement of said lever as said plate is pivoted by resetting movement of said cam.

* * * * *